US008702266B1

(12) United States Patent
Montgomery

(10) Patent No.: US 8,702,266 B1
(45) Date of Patent: Apr. 22, 2014

(54) HANDHELD TRAFFIC CONTROL LAMP

(76) Inventor: Stephen P. Montgomery, Columbia, KY (US)

( * ) Notice: Subject to any disclaimer, the term of this patent is extended or adjusted under 35 U.S.C. 154(b) by 204 days.

(21) Appl. No.: 13/104,641

(22) Filed: May 10, 2011

(51) Int. Cl.
*F21L 4/02* (2006.01)
*F21V 33/00* (2006.01)

(52) U.S. Cl.
USPC ..... 362/184; 362/231

(58) Field of Classification Search
USPC ..... 362/184, 185, 231, 223, 224, 217.02, 362/217.1, 217.14, 247, 249.12, 296.01, 362/296.05, 577, 109, 119, 120, 186, 211; 340/321, 331, 908
See application file for complete search history.

(56) References Cited

U.S. PATENT DOCUMENTS

| | | | | |
|---|---|---|---|---|
| 1,943,059 | A | 1/1934 | Dana | |
| 2,434,741 | A * | 1/1948 | Pramschiefer et al. | 340/321 |
| 2,799,854 | A | 7/1957 | Barnes | |
| 3,197,757 | A | 7/1965 | Porta | |
| 4,593,533 | A * | 6/1986 | Alsenz | 62/140 |
| 5,436,814 | A * | 7/1995 | Hanley | 362/216 |
| 5,905,441 | A | 5/1999 | Klee et al. | |
| 6,722,771 | B1 | 4/2004 | Stephens | |
| 7,287,874 | B2 * | 10/2007 | Irisawa | 362/233 |
| 7,293,893 | B2 | 11/2007 | Kim | |
| D574,741 | S | 8/2008 | Gadsden | |
| 2008/0212319 | A1 * | 9/2008 | Klipstein | 362/231 |
| 2010/0225246 | A1 * | 9/2010 | Spartano et al. | 315/294 |
| 2011/0286206 | A1 * | 11/2011 | Tucker et al. | 362/184 |

* cited by examiner

*Primary Examiner* — Nimeshkumar Patel
*Assistant Examiner* — Glenn Zimmerman

(57) ABSTRACT

A handheld traffic control lamp is provided for facilitating temporary traffic control by an individual. The lamp includes a base configured for being held by a hand. A first light is coupled to and extends from the base. A second light of a different color is coupled to and extends from the base. A power source is operationally coupled to the first light and the second light. A switch is coupled to the base unit and operationally coupled between the first light, the second light, and the power source. The switch is manipulated to alternately illuminate the first light and the second light. The first light and the second light are preferably red and green to mimic known traffic signals.

7 Claims, 3 Drawing Sheets

HANDHELD TRAFFIC CONTROL LAMP

BACKGROUND OF THE DISCLOSURE

Field of the Disclosure

The disclosure relates to traffic control devices and more particularly pertains to a new traffic control device for facilitating temporary traffic control by an individual.

SUMMARY OF THE DISCLOSURE

An embodiment of the disclosure meets the needs presented above by generally comprising a base configured for being held by a hand. A first light is coupled to and extends from the base. A second light of a different color is coupled to and extends from the base. A power source is operationally coupled to the first light and the second light. A switch is coupled to the base unit and operationally coupled between the first light, the second light, and the power source. The switch is manipulated to alternately illuminate the first light and the second light. The first light and the second light are preferably red and green to mimic known traffic signals.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
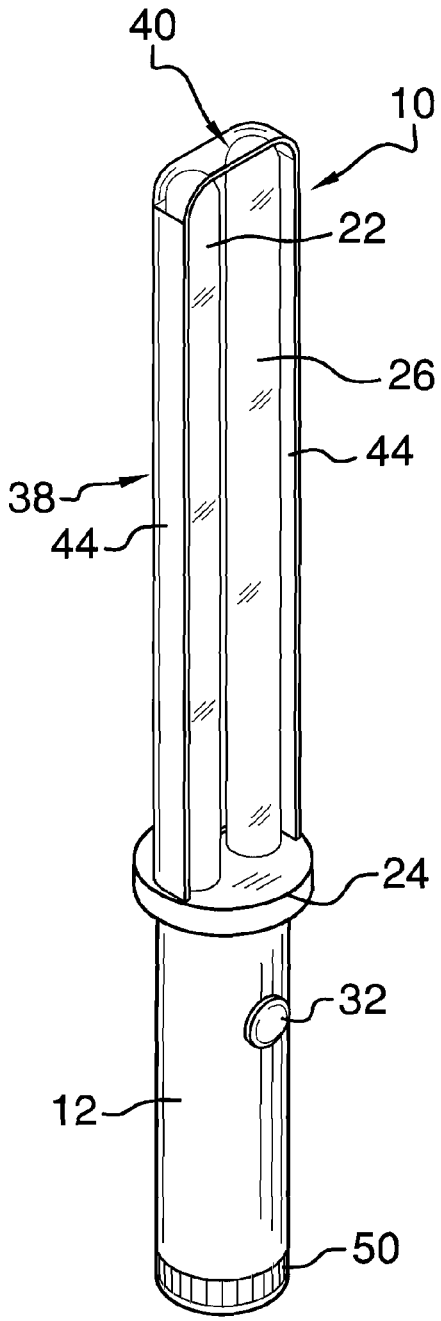
FIG. 1 is a top front side perspective view of a handheld traffic control lamp according to an embodiment of the disclosure.
Figure 2:
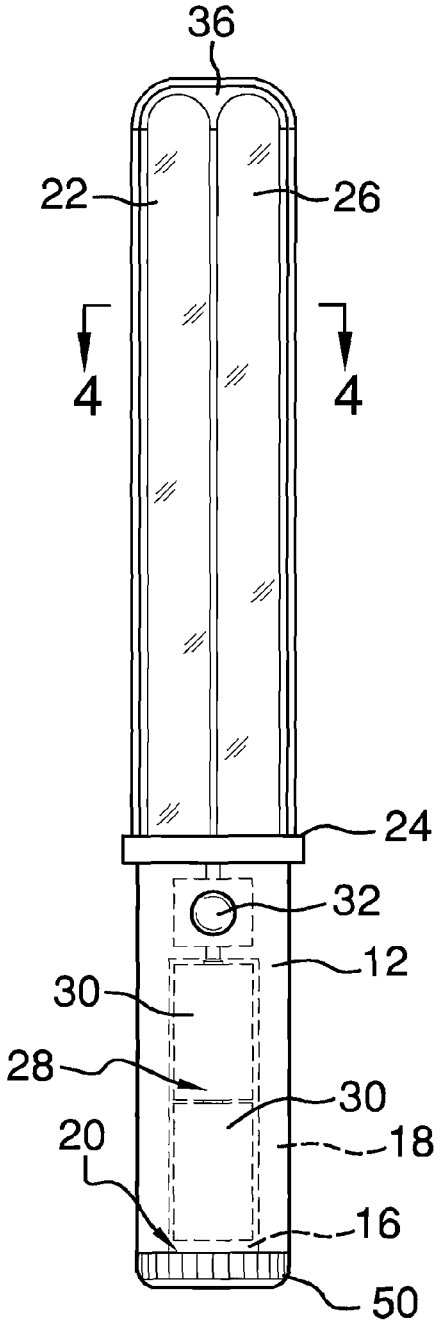
FIG. 2 is a front view of an embodiment of the disclosure.
Figure 3:
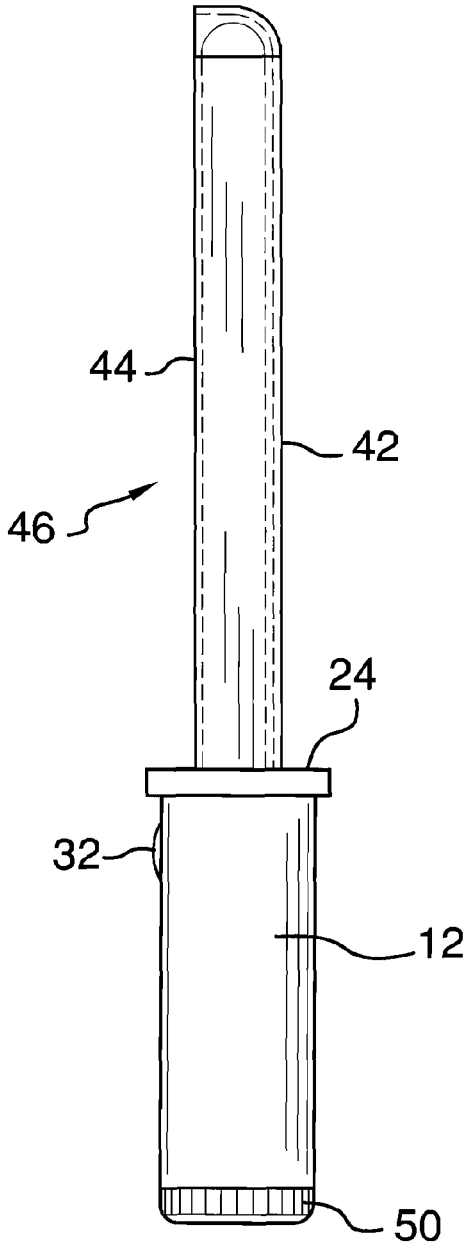
FIG. 3 is a side view of an embodiment of the disclosure.
Figure 4:
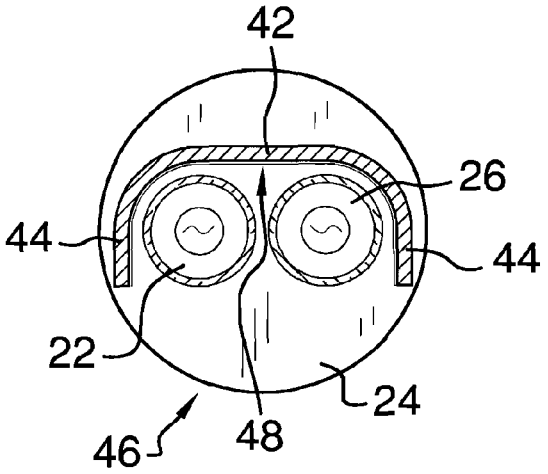
FIG. 4 is a cross-sectional view of an embodiment of the disclosure taken along line 4-4 of FIG. 2.
Figure 5:
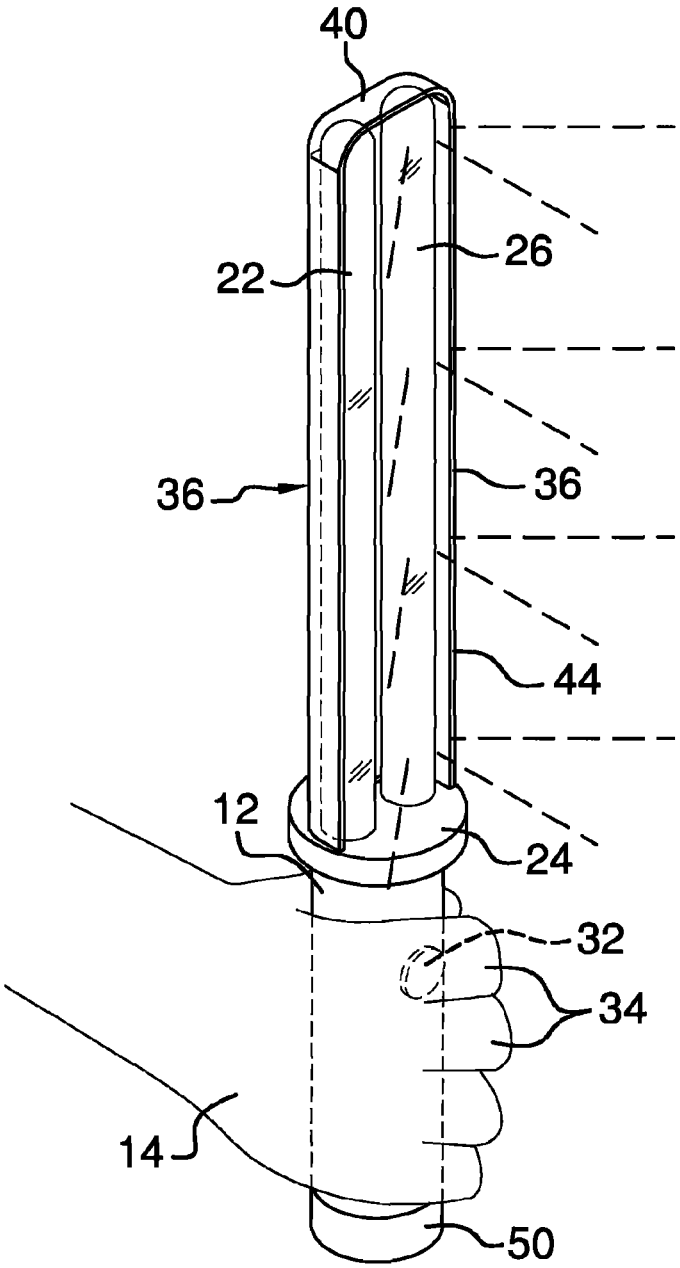
FIG. 5 is a top front side perspective view of an embodiment of the disclosure in use.

With reference now to the drawings, and in particular to FIGS. 1 through 5 thereof, a new traffic control device embodying the principles and concepts of an embodiment of the disclosure and generally designated by the reference numeral 10 will be described.

As best illustrated in FIGS. 1 through 5, the handheld traffic control lamp 10 generally comprises an elongated cylindrical base 12 configured for being held by a hand 14. The base 12 includes a perimeter wall 18 extending around an interior space 16 and defining an open bottom end 20 of the base 12. A removable cover 50 is coupled to the base 12 so the interior space 16 is enclosed by the base 12 and the cover 50.

An elongated first light 22 is coupled to and extends from a top end 24 of the base 12. The first light 22 is a first color, preferably red. An elongated second light 26 is also coupled to and extends from the top end 24 of the base 12. The second light 26 is a second color, preferably green. A power source 28 is operationally coupled to the first light 22 and the second light 26. The power source may be a battery 30 or series of batteries positioned in the interior space 16 of the base 12. A switch 32 is coupled to the base 12. The switch 32 is operationally coupled between the first light 22, the second light 26, and the power source 28. Thus, the switch 32 may be manipulated to alternately illuminate the first light 22 and the second light 26. The switch 32 is positioned on the base 12 proximate the top end 24 of the base 12. The switch 32 is configured for being pressed by a single digit 34 of the hand 14 holding the base 12. The switch 32 may be a three way switch which cycles through illuminating the first light 22 only, the second light 26 only, and then deactivates the first light 22 and the second light 26. Preferably, the first light 22 is red indicating that a driver should be stopped so that accidental or initial activation of the invention will not result in unintended traffic movement.

A shroud 36 may be coupled to and extend from the base 12. The shroud 36 is positioned adjacent to the first light 22 and the second light 26. The shroud 36 further includes a medial portion 38 and a rounded end portion 40. The medial portion 38 of the shroud 36 has a back portion 42 and opposite side portions 44 extending from the back portion 42. Thus, the medial portion 38 extends around the first light 22 and the second light 26 so the first light 22 and second light 26 are visible only from a front side 46 of the lamp 10. The shroud 36 further includes an inwardly facing surface 48 adjacent to the first light 22 and the second light 26. The inwardly facing surface 48 may be reflective to enhance visibility of either the first light 22 or the second light 26 when they are illuminated. The end portion 40 may be transparent or translucent to provide 360 degree viewing of which light is illuminated.

In use, the lamp 10 replaces the common flashlight during situations in which traffic is temporarily diverted by an individual, typically a public official such as a police officer. The base 12 is held and the switch 32 is manipulated to cycle through alternately illuminating the first light 22 and the second light 26. This provides a red light signal and a green light signal, clearly understood common traffic signal colors that clarify the intentions of the person directing traffic.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A handheld traffic control lamp assembly comprising:

a base configured for being held by a hand;

a first light coupled to and extending from said base, said first light being a first color, said first light being elongated;

a second light coupled to and extending from said base, said second light being a second color, said second light being elongated;

a power source operationally coupled to said first light and said second light; and a switch coupled to said base unit, said switch being operationally coupled between said first light, said second light, and said power source whereby said switch is manipulatable to alternately illuminate said first light and said second light, said switch being positioned on said base proximate a top end of said base, said first light and said second light extending from said top end of said base whereby said switch is configured for being pressed by a digit of the hand holding said base; and a shroud coupled to and extending from said base, said shroud being positioned adjacent to said first light and said second light, wherein said shroud further includes a medial portion and an end portion, said medial portion of said shroud having a back portion and opposite side portions extending from said back portion whereby said medial portion extends around said first light and said second light, said shroud further comprising an inwardly facing surface extending along said medial portion adjacent to said first light and said second light, said inwardly facing surface being reflective, said first light and said second light each extending to said end portion of said shroud beyond a border between said medial portion and said end portion, said end portion of said shroud being transparent wherein each of said first light and said second light is visible through said end portion of said shroud.

2. The assembly of claim 1, wherein said base includes an interior space, said power source being positioned in said interior space of said base.

3. The assembly of claim 2, wherein said power source is a battery.

4. The assembly of claim 1, wherein said first color is red and said second color is green.

5. The assembly of claim 1, wherein said switch cycles through illuminating said first light only, said second light only, and deactivating said first light and said second light.

6. The assembly of claim 2, further comprising:

said base having a perimeter wall extending around said interior space and defining an open bottom end of said base; and a cover coupled to said base whereby said interior space is enclosed by said base and said cover.

7. A handheld traffic control lamp assembly comprising:

a base configured for being held by a hand, said base including an interior space, said base having a perimeter wall extending around said interior space and defining an open bottom end of said base;

an elongated first light coupled to and extending from said base, said first light being a first color, wherein said first color is red;

an elongated second light coupled to and extending from said base, said second light being a second color, wherein said second color is green;

a power source operationally coupled to said first light and said second light, wherein said power source is a battery, said power source being positioned in said interior space of said base;

a switch coupled to said base unit, said switch being operationally coupled between said first light, said second light, and said power source whereby said switch is manipulatable to alternately illuminate said first light and said second light, said switch being positioned on said base proximate a top end of said base, said first light and said second light extending from said top end of said base whereby said switch is configured for being pressed by a digit of the hand holding said base, wherein said switch cycles through illuminating said first light only, said second light only, and deactivating said first light and said second light;

a shroud coupled to and extending from said base, said shroud being positioned adjacent to said first light and said second light, wherein said shroud further includes a medial portion and an end portion, said medial portion of said shroud having a back portion and opposite side portions extending from said back portion whereby said medial portion extends around said first light and said second light, wherein said shroud further includes an inwardly facing surface adjacent to said first light and said second light, said inwardly facing surface being reflective, said first light and said second light each extending to said end portion of said shroud beyond a border between said medial portion and said end portion, said end portion of said shroud being transparent wherein each of said first light and said second light is visible through said end portion of said shroud; and a cover coupled to said base whereby said interior space is enclosed by said base and said cover.

* * * * *